United States Patent [19]

Andrews

[11] 3,999,313

[45] Dec. 28, 1976

[54] TOWED SLED FOR DEEP-SEA PARTICLE HARVEST

[75] Inventor: James E. Andrews, Kailua, Hawaii

[73] Assignee: Hawaii Marine Research, Inc., Kaneohe, Hawaii

[22] Filed: Feb. 10, 1975

[21] Appl. No.: 548,301

[52] U.S. Cl. ..... 37/69; 37/DIG. 8; 299/8

[51] Int. Cl.[2] ..... E02F 3/14

[58] Field of Search ..... 37/55, 57, 69, DIG. 8, 37/58; 299/8, 9

[56] References Cited

UNITED STATES PATENTS

| | | | |
|---|---|---|---|
| 82,376 | 9/1868 | Boschke | 37/69 |
| 610,763 | 9/1898 | Kibling | 37/69 |
| 991,333 | 5/1911 | Lybeck | 37/57 X |
| 1,190,224 | 7/1916 | Drouard | 37/57 |
| 1,705,428 | 3/1929 | Twiford | 37/57 X |
| 2,217,412 | 10/1940 | Jackson et al. | 37/55 |
| 2,978,819 | 4/1961 | Paulson | 37/57 |
| 3,238,708 | 3/1966 | Zickefoose | 37/55 X |
| 3,310,894 | 3/1967 | Ball | 37/57 X |
| 3,440,742 | 4/1969 | Goldstein, Jr. | 37/57 |
| 3,624,932 | 12/1971 | Doyle | 37/55 |

FOREIGN PATENTS OR APPLICATIONS

| | | | |
|---|---|---|---|
| 692,998 | 8/1964 | Canada | 37/58 |
| 780,571 | 4/1935 | France | 299/9 |

*Primary Examiner*—E. H. Eickholt
*Attorney, Agent, or Firm*—Townsend and Townsend

[57] ABSTRACT

A method and apparatus for harvesting the ocean floor is disclosed. A sled connected to a vessel is towed over the ocean floor. The sled is supported by spaced apart runners that mount an upwardly open container in which particles to be harvested are collected as the sled is drawn forwardly by the vessel. A cable extends from the vessel to the container and is driven in a forward direction. Buckets are mounted to the cable and have a forwardly directed open end. The cable is guided so that the buckets are moved through the container of the sled to thereby pick up the particles and convey them to the vessel. The sled includes means for dislodging the particles to be harvested from the ocean floor, and for separating from the particles silt and other undesirable contaminants of a size smaller than the particles.

8 Claims, 9 Drawing Figures

FIG_3
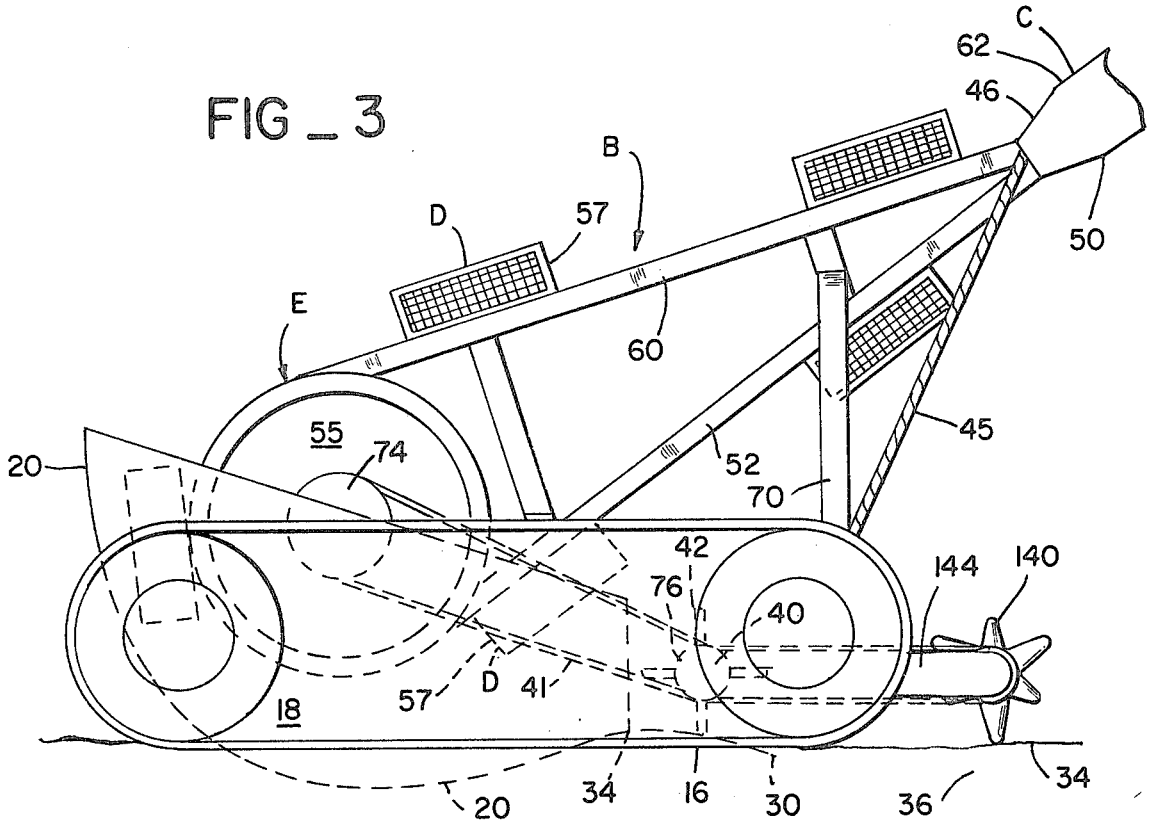
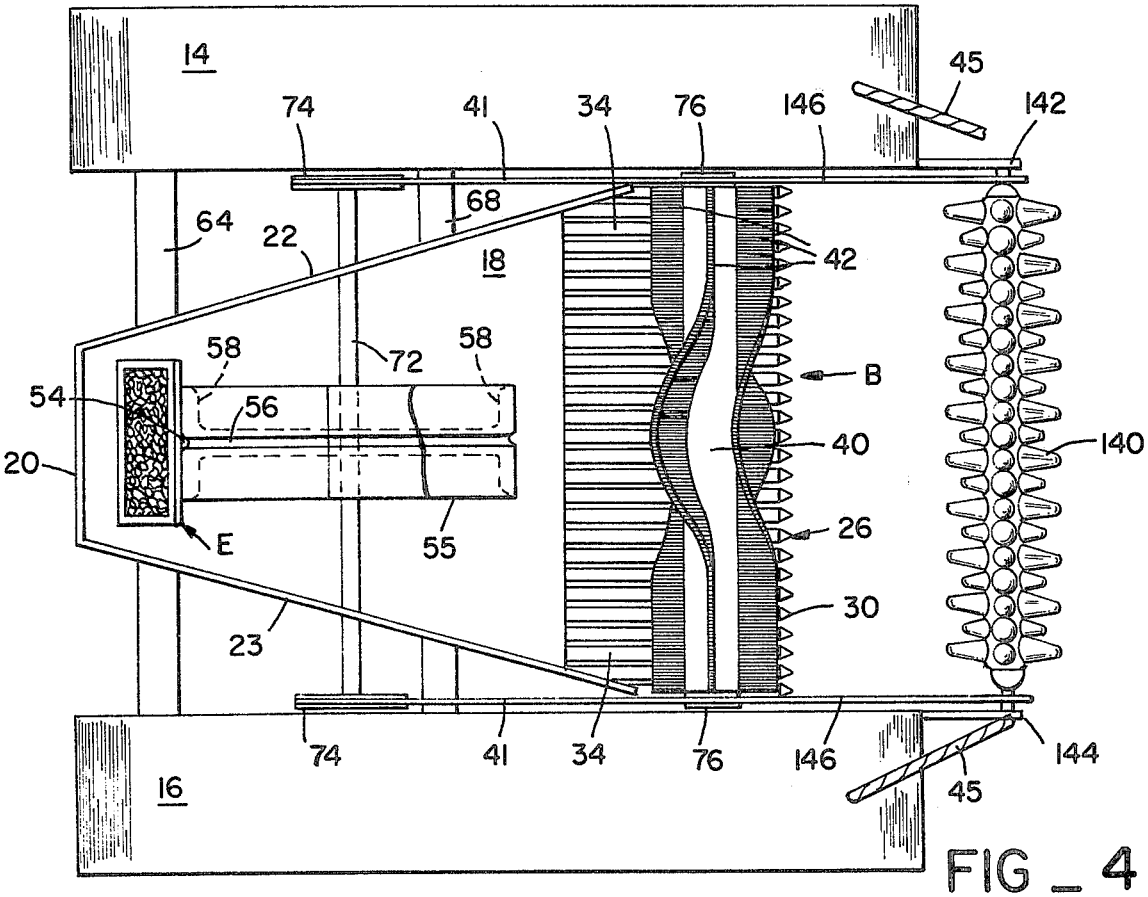
FIG_4

TOWED SLED FOR DEEP-SEA PARTICLE HARVEST

This invention relates to an apparatus for towed conveyance along a deep-sea bottom for collecting particles such as nodules.

STATEMENT OF THE PROBLEM

It has been found and is known that the sediment water interface of deep-sea bottoms is mineral rich in many areas. For example, ferromanganese nodules and phosphorite nodules in the range of 2 to 20 centimeters of diameter (average diameter 5 to 8 centimeters) are found. These nodules are typically round, have a density of approximately 2.4 times that of water and are found as a monolayer in the sediment water interface at a deep-sea bottom. Such nodules can have a variable surface density on the ocean bottom frequently ranging from 10 to 20 kilograms per meter squared of sea bottom. They are commonly found below 1,000 feet of ocean and can be as deep as 15,000 to 20,000 feet in the ocean. Additionally, precious corals and phosphate nodules and crusts are also found on the sea bottom.

These particles are commonly at least partially immersed in a water-saturated sediment or ooze. Typically, the ooze comprises small particles of around 200 microns diameter with a density of 1.8 to 2 times that of water. Unlike the nodules, crusts, corals and sands, the porosity of the surrounding sediment is in the range of 70 to 85% with the water content in the range of 200 to 400%. Thus, as to mineral particles at the sediment water interface, these particles are typically at least partially immersed in an "ooze" ground condition not known to air exposed earth and present their own unique submarine mining problems.

SUMMARY OF THE PRIOR ART

Heretofore, collection of minerals at the sediment ocean bottom interface has usually been conducted by towing open buckets on an endless belt and by dragging a segment of the endless belt along a wide swathe along the ocean floor. These buckets randomly collect particles from the ocean floor over the wide swathe and thereafter are used themselves to elevate the harvested particles to the surface. An example of such an apparatus is shown in Masuda et al. U.S. Pat. No. 3,672,079.

Such independently towed buckets towed in series one behind another on their endless belt do not constitute a central collection point. They therefore cannot be monitored or observed in their collection. Moreover, there is no controlled rate of harvest to a given mineral rich ocean area. The area can typically not be harvested efficiently in side-by-side rows. Additionally, the handling of the independently towed buckets on their cable frequently causes entanglements. Entanglements of the cables both at the ocean floor and in transient to and from the ocean floor occurs.

It is known to have a motorized vehicle move along the ocean floor to collect mineral particles. See, for example, Steele et al. U.S. Pat. No. 3,504,943. Typically, such vehicles collect particles to a column of rising water. The particles are accumulated in rising water and are entrained in the water flow to the surface.

Such self-motorized vehicles have numerous problems. For example, either loss of traction on the ocean floor or alternatively failure of their motors occurs.

Moreover, the ambient sediment on the ocean floor is frequently entrained with the particles during their hydraulic conveyance to the surface. Thus, imperfect classification of the sediment from the harvested particles typically occurs at the ocean floor. Moreover, such particle harvesters and their ocean bottom collector vehicles commonly include pulverizing mechanisms for pulverizing the harvested particles. Such mechanisms are maintained in operable condition only with difficulty at the ocean floor.

SUMMARY OF THE INVENTION

A specialized sled with emptying elevator apparatus at the sled is disclosed for the harvest of particles such as nodules from a deep-sea ocean floor. The sled typically includes at least two spaced apart runners bearing on the ocean floor while the sled is towed. Typically, a particle dislodging and preferably leading edge penetrates between the runners into the sea bottom. Rearwardly of this edge are typically converging bottom, side and end walls defining a particle receiving trough open at the top. Preferably, the bottom includes a series of fore and aft disposed slats defining small, open spatial intervals there between. Overlying both the particle dislodging leading edge and the slats, a rotating and winnowing brush is provided to extend across the sled normal to its towed path. This brush typically has rows of rotating tines. Preferably, the tines of the rotating brush at the sides of the trough are rotationally advanced with respect to the tines at the center of the sled. The brush rotates so that its bristles in close contact with the bottom of the sled move along a tangent in the direction that the ocean floor moves relative to the sled. Typically, the sled dislodges and the brush sweeps particles continuously into a concentrator collector area defined interiorly of the converging trough in the towed sled. An elevator mechanism comprising a large wheel with a series of buckets attached thereto, preferably on an endless belt, sweeps the collection area of the towed sled. The sled, in its towed path over the ocean bottom, includes the process of scraping the particles from the ambient ocean sediment at their surface monolayer and winnowing the sediment from the particles within the sled at the ocean bottom. This winnowing occurs by at least scarifying the particles out from the ocean sediment, winnowing away the sediment from the particles by means of the rotating collector brush in passing water to leave the entrained sediment in the wake of the towed sled with the particles accumulated interior of the towed sled. The process concludes with the concentrating of the particles in the collection area interior of the towed sled into the path of an elevator mechanism which comprises the series of buckets. Provision is made for the placement or substitution at the leading edge of the trough of a scarifyer, a crust head for dislodging ocean bottom crusts or, alternately, a coral head for slicing precious coral particles at their tree stems from the ocean floor.

OBJECTS AND ADVANTAGES OF THE INVENTION

An object of this invention is to disclose a sled which can classify at the ocean bottom collected particles from the ambient sediment or ooze in which the particles are found. According to this aspect of the invention, a towed sled with an open and exposed particle collecting concavity or trough is set forth. Particles are dislodged at the leading and open end of the trough and collected interior of the sled as the sled is towed across the ocean floor. At the point of particle dislodgement, a winnowing brush urges the particles interior of the sled to a collecting point.

An advantage of this invention is that the dislodging classifies the particles from the surrounding ooze or sediment as the sled is towed along the ocean floor.

A further advantage of this invention is that the rotating brush mechanism has the effect of winnowing away the ambient sediment or ooze from the particles.

A further advantage of this invention is that the sled leaves entrained in its wake the classified sediments as it is towed along the ocean floor. The harvested particles in its interior are retained for elevation to the surface.

A further object of this invention is to provide for a convenient accumulation of particles, such as nodules, at a towed collection point along the sea bottom from which they may be conveniently elevated to the surface. According to this aspect of the invention, a towed sled with an open trough has a leading apparatus for the dislodging of the particles. In one preferred embodiment, this apparatus comprises a scarifyer which dislodges and accumulates the particles at the leading edge of a towed trough. Thereafter, a brush sweeps the dislodged particles into an accumulation channel interior of the sled. From this accumulation channel the particles can be conveniently conveyed to the surface.

An advantage of the towed trough is that there is a natural accumulation of particles to be harvested at and behind the scarifyer in the vicinity of a sweeping brush. The brush can then cause movement of the particles to the elevator area of the sled.

A further advantage of this aspect of the invention is that the scarifyer or other particle dislodgement apparatus imparts to the sled a natural vibrational motion. This natural vibrational motion tends to cause particles such as nodules to move rearwardly to a collection area interior of the sled from which the harvested particles can be elevated.

A further object of this invention is to disclose in combination with the sled an area where a sequence of buckets can be passed at varying speeds to empty a collection area in a conveyed sled. According to this aspect, the conveyed trough is provided with an open top. Particles to be harvested are channeled into a collection area, which area is directly in the path of the buckets of an elevator mechanism. Typically, the buckets are conveyed on a wheel through the particle accumulation area of the sled with their open end toward the direction of conveyance. Particles are collected and conveyed from the sled.

An advantage of this aspect of the invention is that the actual collection of the elevator apparatus interior of the sled can be observed and monitored, typically by remote television cameras.

A further advantage of this aspect of the invention is that the rate at which harvest of particles occurs is adjustable. The rate at which the sled is towed can be varied. Alternately, the rate at which the elevator operates can be varied. Finally, both the tow rate and elevator rate can be varied to effect efficient collection of particles from the ocean floor to meet changing particle densities in the collection area on the ocean floor.

A further object of this invention is to provide a simplified drive for apparatus such as the rotating brush on the sled. According to this aspect of the invention, powering of all apparatus on the sled is accomplished by direct linkage to a sled mounted wheel over which the conveying buckets of the sled mounted elevator pass.

An advantage of this aspect of the invention is that the rate of sled mounted operation can be coupled directly to the rate of elevator collection which in turn relates to particle density. Operation of sled mounted particle processing apparatus is not dependent upon either a separate sled mounted motor or, alternatively, the rate at which the sled passes over the ocean bottom.

Other objects, features and advantages of this invention will become more apparent after referring to the following specification and attached drawings in which:

FIG. 3 is a side elevation of the mineral harvesting sled of this invention;

FIG. 4 is a plan view of the mineral harvesting sled;

Figure 1:
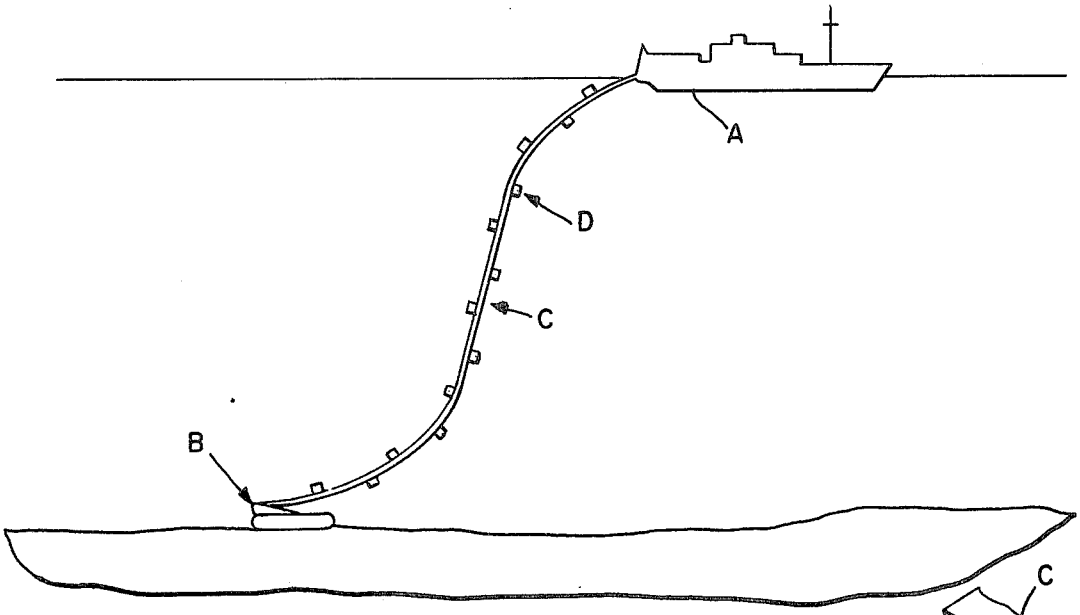
FIG. 1 is a side elevation section of a towing vessel on the surface pulling the ocean bottom mining apparatus or sled of this invention along a sea bottom.

Referring to FIG. 1, towing vessel A is shown towing sled B with flexible strip C. Strip C has conveyed thereon a series of buckets D which serve to empty particles harvested at the sled, elevate them along strip C and deposit them interior of vessel A.

Figure 2:
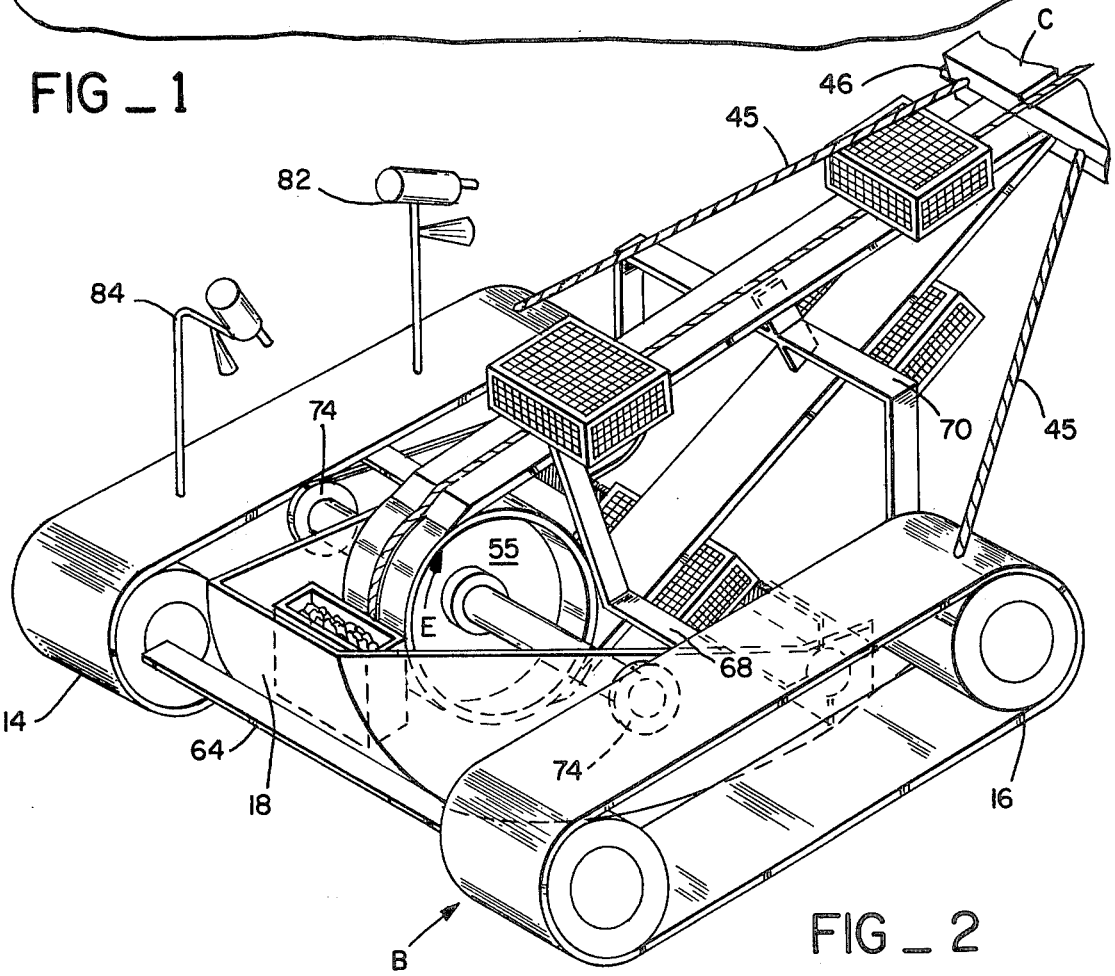
FIG. 2 is a perspective view of the mineral harvesting apparatus or sled of this invention.

In order to understand the apparatus here shown, it will be convenient first to set forth and discuss the sled with reference to FIGS. 2–4. Thereafter, the conveying strip C and the series of endless buckets D will be set forth with reference to FIG. 5. Finally, the handling of strip C and buckets D on vessel A will be set forth with respect to FIG. 6.

Referring to FIGS. 2–4, towing sled B consists of paired runners 14, 16 and intermediate particle gathering trough 18. Particle gathering trough 18 includes an arcuate bottom wall 20 and two converging sidewalls 22, 23. As will hereinafter be set forth fully and in more detail, particles harvested pass interiorly of trough 18 along the arcuate bottom and end wall 20. Simultaneously, particles are converged by the sidewalls 22, 23 into the path of elevator mechanism E.

Preferably, each of the tracks 14, 16 of the sled B is approximately 2 meters wide. The open front leading edge 26 of the trough between the tracks is approximately 6 meters wide. The entire sled is considerably heavier than the density of water so that during towing it will pass in a mineral collecting contact with the ocean bottom.

It should be noted that both the width of tracks 14, 16 as well as the width of trough 18 will be a design function of the density of the ocean floor being mined.

At leading edge 26, the sled is provided with a scarifyer 30 (shown in the views of FIGS. 3 and 4). Two important features should be noted about the scarifyer 30. First, it penetrates with individual spaced apart tines into the layer of mineral particles 34 and sediment 36 to classify out the mineral particles. Thus, the minimum spacing between the individual tines of the scarifyer 30 is such that the sediment can pass between the tines while the desired mineral particles cannot pass between the tines. For example, where mineral particles of up to 2 centimeters of diameter are to be harvested, the spacing between the individual tines of the scarifyer would be in the order of less than 2 centimeters.

Second the scarifyer is mounted well aft of the leading edge of the sled tracks 14, 16. This is done so that the track can bear down on the ooze or sediment of the ocean floor and prevent the sled from overturning forwardly due to the interaction of the sled being towed and the penetration of scarifyer 30 into the ocean bottom.

Rearwardly of scarifyer 30, the sled B is provided with a series of fore and aft slats 34. Slats 34 extend slightly above the elevation of the tracks 14, 16 and extend rearwardly to and are a part of the bottom arcuate wall 20 of the collector trough 18.

Overlying the collector trough entrance, rearwardly of the scarifyer 30, there is a rotating brush 40. Rotating brush 40 is typically driven by belt mechanisms 41 from the elevator mechanism E.

The function of brush 40 can be readily understood. As sled B is pulled through and along the sediment water interface at the bottom of the sea, scarifyers 30 will dislodge and cause the accumulation immediately behind its leading edge of mineral particles from the ocean bottom. These particles will be contacted by rotating brush 40, urged over the slats 34, and downwardly into the arcuate bottom 20 of the collector trough 18.

It will be understood that once the particles are contacted by the scarifyer 30, classification of the particles from the ambient sediment or ooze on the ocean floor will begin.

As the particles are brushed by rotating brush 40 over the slats 34, classification of the particles from the ambient sediment or ocean bottom ooze will occur due to at least three effects.

First, brush 40 will tend to knock the particles rearwardly and, at the same time, cause the sediment 36 in which they are found to pass between the spatial intervals defined by the fore and aft slats 34. Secondly, rotating brush 40 will, by virtue of its individual tines 42, winnow away the sediment from around the particles. Finally, the sled itself being towed through the water will tend to leave in its wake the agitated sediment while the mineral particles are retained interiorly of the trough 18.

Towing of the sled occurs through two cables 45 attached at runners 14, 16 at points 47 at the upper forward end of the runners with each cable converging upwardly to a towing bridle 46. Towing bridle 46 is in turn connected to the lower end of the strip C and is the point at which sled B is towed along the ocean floor. As will hereinafter become more apparent, strip C and buckets D serve together to tow sled B and empty sled B to vessel A as sled B moves along the ocean floor.

Buckets D are conveyed into the interior of trough 18 along a bottom railway 50 on strip C. They then pass between the wheel 55 of elevator mechanism E and strip C on a track 52. These individual buckets D are conveyed on an endless cable 54 in a defined groove 56 on wheel 55 so as to pass around that portion of wheel 55 in contact with endless cable 54. It should be noted that wheel 55 is provided with a rim 58 to hold bucket D securely and radially outward of wheel 55.

It should be appreciated that the buckets pass along arcuate bottom 20 of trough 18 along a tangent with respect to the ocean bottom which is the reverse of the direction in which sled B is towed. Thus, the buckets will not only serve to gather in at their open end 57 particles to be harvested, but will additionally cause the rearward converging movement of the ocean bottom particles at their leading and open end.

As can be seen, each open ended bucket D will sweep in close proximity to the arcuate bottom 20 of trough 18. Thereafter, the buckets will be conveyed to an overlying track 60 extending between wheel 55 and strip C. Finally, bucket D will be conveyed to the upper surface 62 of strip C at towing bridle 46.

To support both trough 18 and runners 14, 16, as well as the conveyor paths 52, 60, a series of cross braces 64, 68 and 70 are provided. These respective cross braces maintain the spatial separation between runners 14, 16 of the sled, hold trough 18 intermediately of the paired sled runners, and additionally furnish the structural support for the bucket paths 52, 60 between wheel 55 and towing bridle 46.

It should be apparent that rotating brush 40 can be powered by an electric motor mounted interiorly of sled B. Preferably, however, wheel 55 is connected to shaft 72 which transpierces sides 22, 23 of trough 18 and extends to belt wheels 74 proximate runners 14 and 16. Wheels 74 through belt mechanisms 41 power belt driving wheels 76 to cause rotation to the winnowing brush 40.

It should be appreciated that the sled, as towed along the ocean bottom, will be subject to vibrations. Vibrations can be expected from the motion of scarifyer 30 through the sediment mineral article interface 34, 36 as well as the vibration of the elevator mechanism collecting and elevating harvested mineral particles 34 and the action of rotating brush 40. As this occurs, it will be appreciated that particles accumulated on slats 34 will tend to fall backwardly and downwardly on arcuate wall 20 of the trough 18 to the elevator mechanism E.

It will be remembered that sled B has the additional advantage of forming a central and moving collection point which can be monitored. Accordingly, two television monitors and accompanying lights on standards 82, 84 are shown. Light and camera 82 illuminate the path into which the sled is being towed. The density and configuration of mineral particles about to be harvested in the anticipated path of the sled can be observed.

Camera and light 84 monitor the elevator apparatus interior of the sled. The accumulation of mineral particles can be observed with correspondent adjustments to the towing speed of sled B or the rate of elevator E as it evacuates particles accumulated interior of trough 18 of the collector sled B.

Figures 5, 5A:
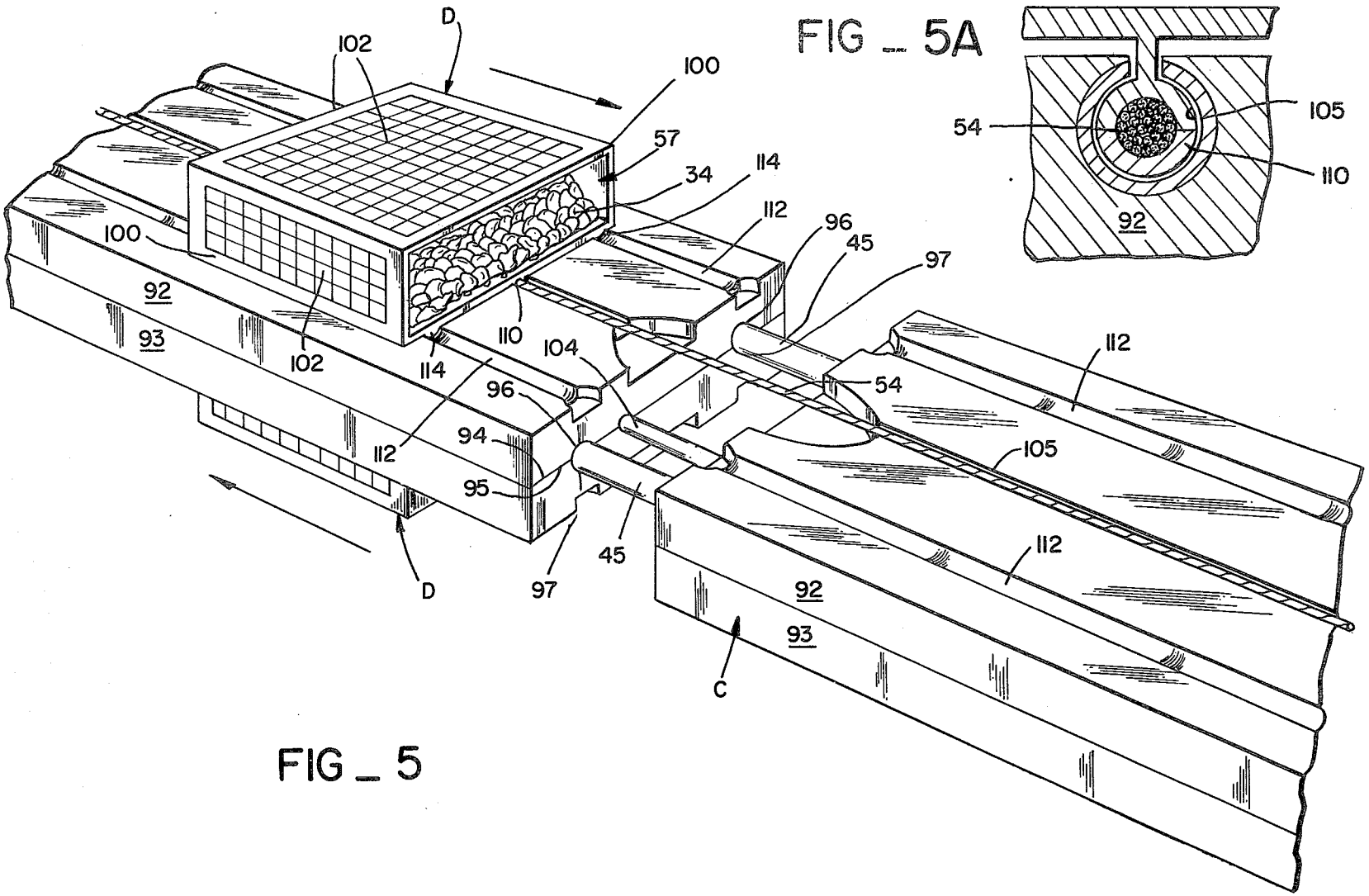
FIG. 5 is a perspective view of the towing strip and conveyed buckets.
FIG. 5A is a view of the cable and grip for confining the conveyed buckets to a path adjacent the towing strip.

Referring to FIGS. 5 and 5A, the construction of the towing strip B can be understood. Typically, cables 45 extend from sled B at the lower end to the fan tail of towing vessel A at the upper end. These cables 45 are reeved at conventional winches 90 on the stern or fan tail of towing vessel A. (See FIG. 6.) Towing cables 45 are typically neutrally buoyant and are preferably constructed of a material having neutral density with respect to sea water. This cable construction material is known as Kelvar, a registered trademark of E. I. DuPont De Numours and Company of Wilmington, Delaware.

Intermediate sled B and vessel A, cables 45 are held in spaced apart relation by upper track members 92 and lower track members 93. These respective track members are confronted at respective mating surfaces 94, 95 and cable grooves 96, 97 to hold the spaced apart cables 45 at an equidistant and parallel spacing from sled B on the ocean floor to the fan tail of towing vessel A.

Preferably, track sections 92, 93 are also neutrally buoyant. Thus, as the cable passes from the sled to the vessel, the buoyant force of the sea water essentially supports the weight of towing strip C and its upper and lower tracks 92, 93.

Buckets D include an angle frame 100 which is closed by screen 102 at bucket sides and end and is open in the direction of conveyance at an opening 57. As is apparent, when the buckets are conveyed along the strip C, water passes through the buckets and through the screen 102 at the sides and end while the harvested particles 34 are captured and thereafter elevated to the surface. Thus, the buckets and the water passing through them can serve to winnow away any remaining sediment 36 from the collected mineral particles 34.

It should be apparent that strip C also forms a convenient conduit for passing protected communication and power cables to sled B. Such communication and power cables are schematically shown at 104.

The drawing of buckets D along towing strip C occurs by means of a traveling endless cable 54 captured interiorly of a cable raceway 105. The individual buckets D are fastened to cable 54 by grips 110 which penetrate interiorly of raceway 105.

It should be noted that the cable grips are captured within the raceway 105. Thus, grips 110 serve a dual purpose. First, they serve to convey buckets D upwardly and to the surface of towing vessel A. Secondly, they serve to capture the individual buckets and hold them on the respective railways 92.

Buckets D slide along grooves 112 at runners 114. These runners serve to preserve the alignment of the buckets D as they pass upwardly and downwardly of the towing track C with their respective open ends 57 confronted to the direction of their movement.

It should be understood that with respect to FIG. 5, only one side of the outwardly exposed section of track 92 has been specifically illustrated. The downwardly exposed track section 93 is of identical construction and therefore is not set forth.

Additionally, it should be apparent that discrete sections of track 92, 93 are fastened along between cables 45 as they pass from sled B to vessel A. Preferably, these track sections are juxtaposed and are not given the spacing shown in FIG. 5, which spacing is only present for increased understanding of the makeup of towing strip C.

Additionally, it will be apparent that where both the cable raceway 105 and the respective grooves 112 come into contact between adjoining segments of tracks 92, 93, flaired portions enlarging these respective grooves and raceways are provided. This is done so that the buckets may easily pass from one discrete track segment to an adjoining or adjacent track segment.

Figure 6:
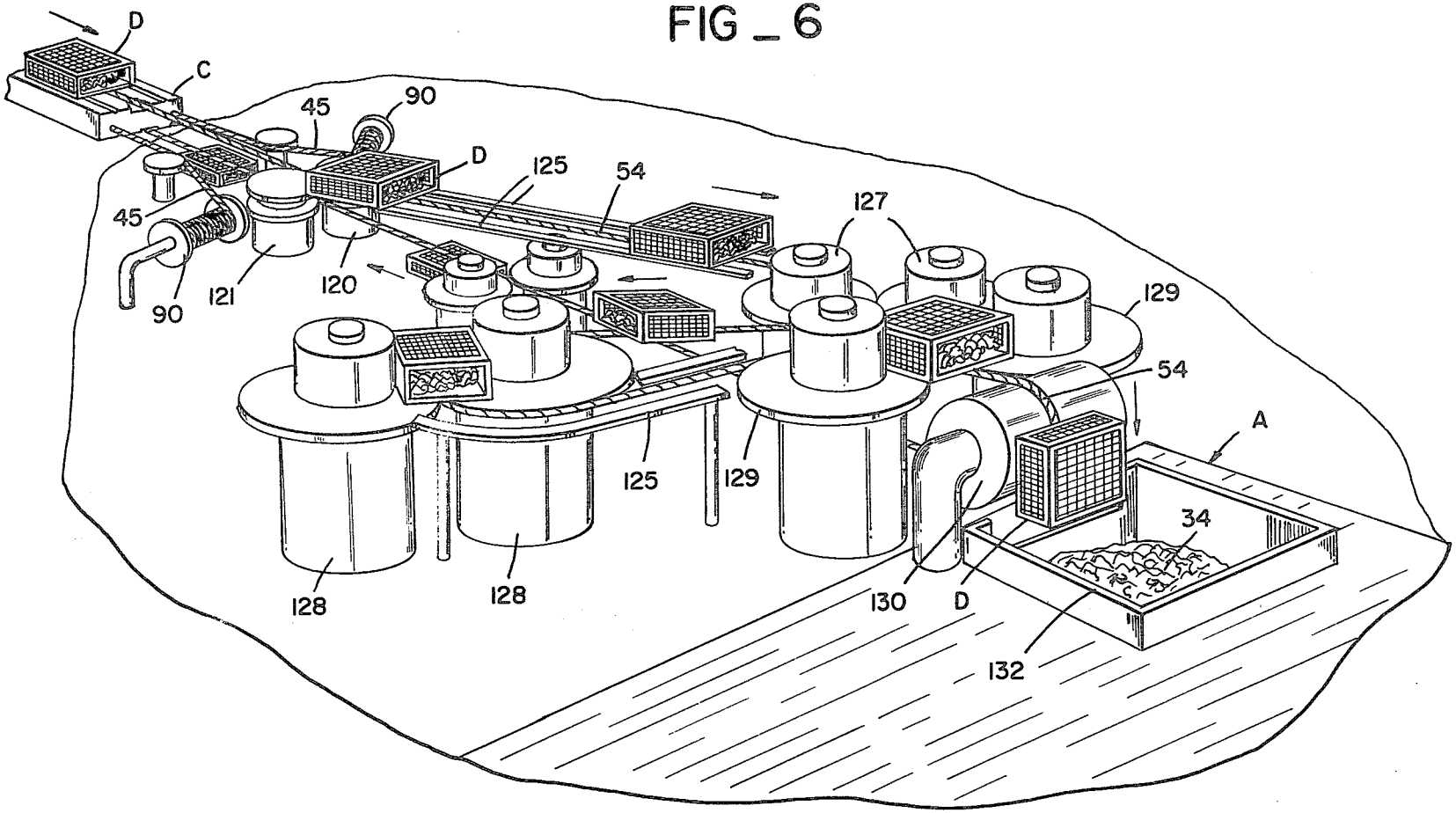
FIG. 6 is a perspective view of the fan tail of the towing ship illustrating the handling of the towing strip and endless belt conveyed buckets.

Referring to FIG. 6, the handling of the buckets D on the fan tail of the towing vessel A is schematically illustrated in a perspective view. Buckets D pass off the surface of strip C and between idling capstans 120 and 121. These buckets D are kept on top of the endless cable 54 to which they are attached by rails 125, which rails are only partially shown in the perspective view of FIG. 6. The buckets pass around and between three pairs of driving capstans 127, 128, 129. The driving capstans, by winding a section of the endless cable 54 around their periphery and imparting a zigzag configuration to the endless belt 54, provide the power to pull the buckets from the towed sled B to vessel A. Cable 54 passes over an emptying drum 130 and empties the elevated mineral particles 34 into a vessel mounted collection bin 132. The endless belt and its respective buckets D then return to the underside of strip C between idler capstans 120, 121 to the ocean floor.

It will be appreciated that sled D can be adapted for the harvest of mineral crusts. To this end there can optionally be attached to the leading edge of sled D a crust head 140 mounted between paired brackets 142, 144. This crust head can be driven to rotate in the same direction as rotating brush 40 by means of belting 146 extending to rotate the crust head 140.

Figure 7:
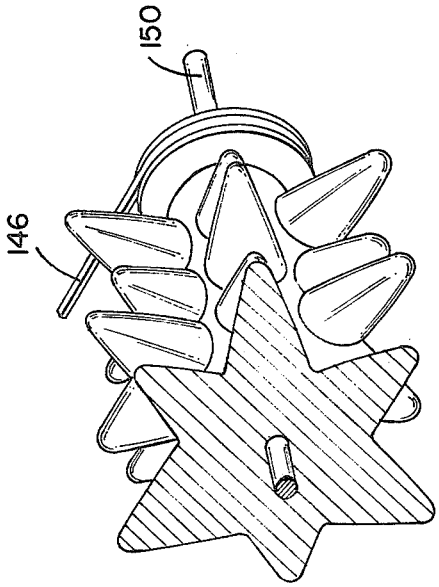
FIG. 7 is a perspective view of a crust head for dislodging crusts from the ocean floor; and, FIG. 8 is a perspective view of a shearing coral head for cutting coral stems along the ocean bottom in advance of the sled.
Figure 7:
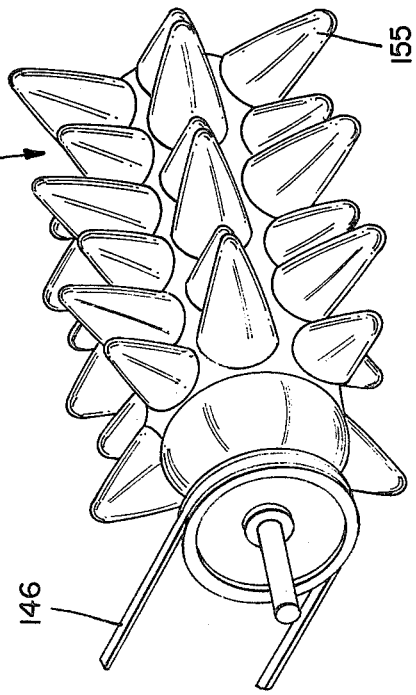

Referring to FIG. 7, a perspective view of the crust head utilized with this invention is illustrated. The crust head 140 includes a shaft 150 with respective belt drive mounted on either side thereof. Preferably, the brackets mounting the crust head to the sled (not shown in the view of FIG. 7) are adjusted so that the individual protuberances 155 protruding from the crust head come into contact with the floor of the sea bottom.

The operation of the crust head shown in FIG. 7 can be readily understood. The crust head rotates in contact with the sea bottom as sled B is towed along its intended path by towing strip C. The individual protuberances 155 penetrate into and break up crusts on the sea bottom. These crusts are then declassified from ambient sediment by the scarifyer mechanism 30, winnowed by brush 40, and swept into trough 18 where they may be elevated by elevator E.

It should also be understood that the sled mechanism of this invention can be used for the harvest of coral forests. A coral cutting head for substitution at the front portion in place of crust head 140 of sled B is shown in the perspective view of FIG. 8.

Figure 8:
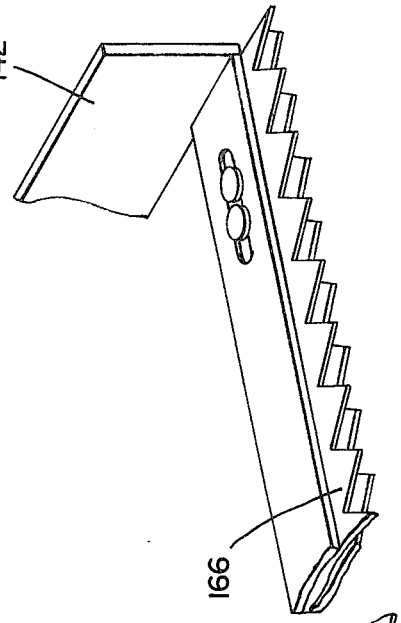
Figure 8:
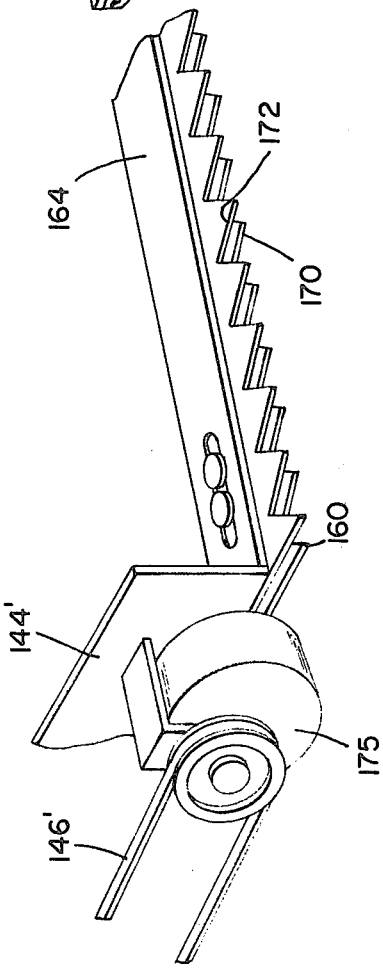

Referring to FIG. 8, two sled mounting brackets 142' and 144' extend forwardly of the sled. These brackets hold lower shearing strip 160 and an upper guide strip 164.

Mounted between shearing strip 160 and guide strip 164 there is a reciprocating blade 166. Blade 166 reciprocates over rigidly held shearing blade 160 to shear coral stems between teeth 170 on rigid blade 160, and teeth 172 on reciprocating blade 166. At least one belt drive 146' is operable through a gear box 175 to effect reciprocation of the reciprocating blade 166.

Regarding the internal mechanisms of gear box 175, such mechanisms are conventional. Suitable drives for the reciprocating blade may be found in Knight's American Mechanical Dictionary published by J. B. Ford & Company, 1895, at pages 1488 and 1491 (Volume II).

The respective teeth 170 and 172 on the stationary blade 160, and on the reciprocating blade 166, should have a minimum 2-inch bite opening between the peaks of the teeth. Reciprocation of the blade 166 should be such that a complete teeth to peak movement of the respective teeth occurs.

It should be apparent that the invention herein disclosed will admit of modification. For example, the towing track C and the configuration of both the driving endless belt 54 and cable grip 110 as well as any mechanism which holds the buckets D firmly to the track can be altered. Likewise, other modifications of this invention as disclosed herein can occur.

I claim:

1. An apparatus for the collection of particles on an ocean floor comprising: a vehicle for towed movement across said ocean floor, said vehicle including an open ended trough with an open and leading edge for sliding movement along said ocean floor, said trough having paired side walls, a bottom wall and an end wall for accumulating particles dislodged from said ocean floor at a collection point interior of said trough; said trough defining an open top for permitting a continuous conveyance of particles accumulated in the interior of said trough outwardly through the top of said trough; means defining a leading edge of the vehicle for removing from the ocean floor a mass of material including said particles and for collecting said mass in the trough; a wheel including a relatively wide peripheral flange rotatably mounted in said trough and including means for looping and guiding belt means about the peripheral flange; and, a series of open ended buckets mounted to a belt means, said belt means threaded over the peripheral flange of said wheel to pass said buckets through said collection point to capture and convey in substantially unpulverized form dislodged particles to the surface of said ocean; said buckets including means for supporting the buckets on the peripheral flange against tipping about the longitudinal axis of the belt means while the buckets and the belt means pass about said wheel.

2. Apparatus for harvesting from the ocean floor particles of a desired size comprising in combination: a sled supported by and to be drawn over the ocean floor by a towing vehicle, the sled including means for connecting it with a towing vehicle, a trough including a bottom defining a leading edge for movement along the ocean floor and for collecting the particles, the sled further including a pair of laterally spaced apart runners for supporting the trough on the ocean floor as it is drawn thereover, the leading edge of the trough trailing a forwardmost contact point between the runners and the ocean floor to stabilize the sled and prevent its tipping while it is being pulled; a particle conveyance system including longitudinally movable cable means extending from the sled to the towing vehicle, a plurality of buckets mounted in spaced relation to the cable means and having open ends facing in the direction of movement of the cable means; pulley means mounted interiorly of the trough; guide means comprising a plurality of serially arranged, interconnected guide members including means for guiding the cable means between the towing vehicle and the pulley means, and means for supporting the baskets against lateral tipping and for guiding the baskets along the trough bottom to fill the baskets through their open end with the particles as the buckets are dropped through the trough and after the baskets have moved past the pulley means during their movement between the pulley means and the towing vehicle.

3. Apparatus according to claim 2 wherein the guide means further include means for supporting the baskets against lateral tipping during their movement from the towing vehicle to the pulley means.

4. Apparatus according to claim 2 wherein the sled includes means for separating from the collected mass particles which are smaller than a predetermined particle size.

5. Apparatus according to claim 2 wherein the buckets have a common width, wherein the pulley means is disposed adjacent an aft end of the trough, wherein an aft portion of the trough through which the buckets are drawn has a width only slightly larger than the width of the buckets, and wherein a portion of the trough adjacent the leading edge has a width substantially greater than the width of the aft end of the trough.

6. Apparatus for harvesting from the ocean floor particles of a desired size comprising in combination: a sled supported by and to be drawn over the ocean floor by a towing vehicle, the sled including means for connecting it with a towing vehicle, a trough including a bottom defining a leading edge for movement along the ocean floor and for collecting the particles, the sled further including a pair of laterally spaced apart runners for supporting the trough on the ocean floor as it is drawn thereover, the leading edge of the trough trailing a forwardmost contact point between the runners and the ocean floor to stabilize the sled and prevent its tipping while it is being pulled; a particle conveyance system including longitudinally movable cable means extending from the sled to the towing vehicle, a plurality of buckets mounted in spaced relation to the cable means and having open ends facing in the direction of movement of the cable means; pulley means mounted interiorly of the trough and including means supporting the baskets against lateral tipping and guiding the baskets along the trough bottom to fill the baskets through their open end with the particles as the buckets are drawn through the trough; means for separating from the collected mass particles which are smaller than a predetermined particle size, said separating means comprising a plurality of spaced apart bars extending rearwardly from the leading edge of the trough, interstices between the bars being dimensioned so as to permit passage of particles of less than the desired size; and, means for agitating the mass and for contacting the particles to be harvested with relatively moving, flexible tines to thereby clean the particles of sedimentation and silt and to entrain loosened sedimentation and silt in water flowing past the sled as the sled is drawn in a forward direction.

7. Apparatus according to claim 6 wherein the means for contacting the particles with tines comprises an elongate brush member having radially protruding tines and positioned above and aft the leading edge of the trough, and including means for rotating the brush as the sled is moved over the ocean floor.

8. Apparatus according to claim 7 wherein the means for rotating the brush comprises means driven by the pulley means for rotating the brush.

* * * * *